US009382495B1

(12) United States Patent
Fang et al.

(10) Patent No.: US 9,382,495 B1
(45) Date of Patent: Jul. 5, 2016

(54) POLYHYDROXYALKYL ETHER AMINES AND FUELS CONTAINING THEM

(71) Applicant: AFTON CHEMICAL CORPORATION, Richmond, VA (US)

(72) Inventors: Xinggao Fang, Midlothian, VA (US); Scott A. Culley, Midlothian, VA (US); Scott D Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 14/855,674

(22) Filed: Sep. 16, 2015

(51) Int. Cl.

| | |
|---|---|
| ***C10L 1/22*** | (2006.01) |
| ***C10L 10/08*** | (2006.01) |
| *C10L 1/222* | (2006.01) |

(52) U.S. Cl.
CPC . *C10L 10/08* (2013.01); *C10L 1/22* (2013.01); *C10L 1/2225* (2013.01); *C10L 2200/0259* (2013.01); *C10L 2230/22* (2013.01); *C10L 2270/023* (2013.01)

(58) Field of Classification Search
CPC ..... C10L 10/08; C10L 1/22; C10L 1/2225; C10L 2200/0259; C10L 2230/22; C10L 2270/023
See application file for complete search history.

(56) References Cited

U.S. PATENT DOCUMENTS

| | | | | |
|---|---|---|---|---|
| 4,231,883 | A | 11/1980 | Malec | |
| 4,391,610 | A * | 7/1983 | Sung | C10L 1/2225 252/392 |
| 4,704,217 | A | 11/1987 | Sweeney et al. | |
| 6,063,145 | A | 5/2000 | Larkin et al. | |
| 6,129,772 | A * | 10/2000 | Weers | C10L 1/14 44/385 |
| 7,435,272 | B2 | 10/2008 | Aradi et al. | |
| 8,425,627 | B2 | 4/2013 | Dietz et al. | |
| 8,821,754 | B2 | 9/2014 | Hellsten et al. | |
| 2011/0065619 | A1 | 3/2011 | Russo | |

* cited by examiner

*Primary Examiner* — Cephia D Toomer
(74) *Attorney, Agent, or Firm* — Luedeka Neely Group, P.C.

(57) ABSTRACT

A fuel additive and method for improving fuel economy in an engine. The method includes providing a fuel composition to an engine, wherein the fuel composition includes gasoline and from about 10 to about 750 ppm by weight based on a total weight of the fuel composition of a fuel stable additive of the formula

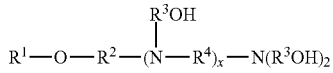

wherein $R^1$ comprises a saturated hydrocarbyl group having from 6 to 30 carbon atoms, $R^2$ is an alkyl, polyalkyl, alkoxyalkyl or polyalkoxyalkyl group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1, and combusting the fuel composition in the engine.

23 Claims, No Drawings

POLYHYDROXYALKYL ETHER AMINES AND FUELS CONTAINING THEM

TECHNICAL FIELD

The disclosure is directed to use of a gasoline fuel composition that improves fuel economy and fuel additives that can be formulated into a fuel additive package that remains in a fluid state at low temperatures. In particular, the disclosure relates to polyhydroxyalkyl ether amine additives that reduce friction or wear of engine parts and improve fuel economy of an engine while remaining stable in a fuel additive package.

BACKGROUND AND SUMMARY

Fuel compositions for vehicles are continually being improved to enhance various properties of the fuels in order to accommodate their use in newer, more advanced engines including direct injection gasoline engines. Accordingly, fuel compositions typically include additives that are directed to certain properties that require improvement. For example, friction modifiers, such as fatty acid amides, are added to fuel to reduce friction and wear in the fuel delivery systems of an engine. However, certain fatty amides may be unstable in additive packages for fuels at low storage temperatures and the performance of such fatty acid amides is often less than desirable. Fuel additives may be passed into the oil sump during engine operation, so that a fuel additive that is also beneficial to the engine lubricant is desirable. While such additives may be beneficially added to the lubricant rather than the fuel, such additive are not effective for improving wear in fuel delivery systems. Also, such additives, when added to the fuel, rather than the lubricant, may reduce friction and wear in the piston ring zone of the engine and thus improve fuel economy. Accordingly, it is beneficial to include additives in fuels to provide both improved fuel delivery system wear protection as well as improved fuel economy.

Partial esters of fatty acid and polyhydroxy alcohols such as glycerol monooleate (GMO) are known as friction modifiers for lubricant compositions. Likewise diethanolamine fatty amides are also well known friction modifiers. While GMO and fatty amide friction modifiers may improve fuel economy when added to a lubricant, GMO and certain diethanolamine fatty amides may be unstable in additive packages for fuels or may cause an increase in intake valve deposits in gasoline engines. Furthermore, fuel economy improvement may be less than desirable when using GMO or certain fatty amides in fuel compositions. Accordingly, GMO and fatty amide friction modifiers cannot be beneficially added to a fuel composition to improve the wear protection of the fuel delivery system without harmful and undesirable side effects.

Fatty amine ethoxylates are also known as fuel additives that may reduce fuel consumption. However, such fatty amine ethoxylates are typically derived from natural sources and thus may vary by region and over time. In addition, some fatty amine ethoxylates have a high freezing points or are solids at room temperature and may require heating or the use of a solvent for storage and handling. Lastly, fatty amine ethoxylates typically have poor low temperature compatibility with fuel compositions.

Certain etheramine polyalkoxylates were believed to be useful as anti-corrosion additives in gasoline fuels. However, such compounds perform poorly with regard to corrosion in a NACE TM0172-2001 corrosion test and may dramatically increase the amount of intake valve deposits in an engine.

Many other friction modifiers have been tried, however there remains a need for a friction modifier that enables a fuel additive packages containing the friction modifier to remain fluid at low temperatures, that is resistant to hydrolysis, that may be readily formulated into a fuel additive packages, that offers good fuel economy benefits, and that provides wear protection to fuel delivery systems, among others characteristics. Accordingly, there continues to be a need for a fuel additive that is cost effective to manufacture and improves multiple characteristics of a fuel.

In accordance with the disclosure, exemplary embodiments provide a method for improving fuel economy in an engine. The method includes providing a fuel composition to an engine, wherein the fuel composition comprises gasoline and from about 10 to about 750 ppm by weight based on a total weight of the fuel composition of a fuel stable additive of the formula

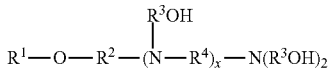

wherein $R^1$ comprises a saturated hydrocarbyl group having from 6 to 30 carbon atoms, $R^2$ is an alkylene, polyalkylene, alkoxyalkylene, or polyalkoxyalkylene group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1, and combusting the fuel composition in the engine.

In another embodiment, there is provided a method for improving the fuel economy in an engine. The method includes providing to the engine a fuel composition, wherein the fuel composition comprises gasoline and from about 10 to about 750 ppm by weight based on the total weight of the fuel composition of a fuel stable additive that is a polyhydroxyalkyl ether amine, wherein the polyhydroxyalkyl ether amine contains one or more tertiary nitrogen atoms and is devoid of primary and secondary nitrogen atoms, and combusting the fuel composition in the engine.

A further embodiment provides a fuel composition that includes gasoline and from about 10 to about 750 ppm by weight based on the total weight of the fuel composition of an additive of the formula

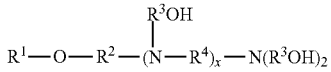

wherein $R^1$ comprises a saturated hydrocarbyl group having from 6 to 30 carbon atoms, $R^2$ is a linear alkylene group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1.

An advantage of the methods described herein is that the additive for the fuel composition may not only improve the friction or wear properties of the fuel, but the additive may also be effective to improve fuel economy without detrimentally affecting the low temperature stability of a fuel additive package containing the additive component.

In one embodiment, the additive is derived from a hydrocarbyl substituted ether amine that is reacted with an epoxide. In another embodiment, the hydrocarbyl group of the hydrocarbyl substituted ether amine contains from 6 to 30 carbon atoms.

In one embodiment, the hydrocarbyl ether amine is a compound of the formula

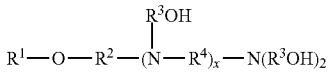

wherein $R^1$ comprises a saturated hydrocarbyl group having from 6 to 30 carbon atoms, $R^2$ is an alkylene, polyalkylene, alkoxyalkylene, or polyalkoxyalkylene group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1.

In a further embodiment, the fuel composition contains from about 10 to about 750 ppm by weight, such as from 40 to about 500 ppm by weight, or from 50 to about 250 ppm by weight of the polyhydroxyalkyl ether amine based on a total weight of the fuel composition.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The fuel additive component of the present application may be used in a minor amount in a major amount of fuel and may be added to the fuel directly or added as a component of an additive concentrate to the fuel. A suitable fuel additive component for improving the operation of internal combustion engines may be made by reacting an ether amine or ether diamine with an epoxide.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

Ether-Amine Compound

According to the disclosure, any suitable ether-amine or ether-diamine may be used to prepare a compound of the formula

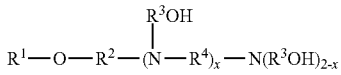

wherein $R^1$ comprises a saturated hydrocarbyl group having from 6 to 30 carbon atoms, $R^2$ is an alkylene, polyalkylene, alkoxyalkylene, or polyalkoxyalkylene group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1. In one embodiment, the amine may be a compound of the formula

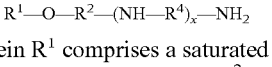

wherein $R^1$ comprises a saturated hydrocarbyl group having from 6 to 30 carbon atoms, $R^2$ is an alkylene, polyalkylene, alkoxyalkylene, or polyalkoxyalkylene group containing from 2 to 25 carbon atoms, $R^4$ is a linear alkyl group containing 2 to 3 carbon atoms, and x is an integer selected from 0 and 1.

Representative etheramines may include, but are not limited to, isohexyloxyethylamine, isohexyloxypropylamine, 2-ethylhexyloxyethylamine, 2-ethylhexyloxypropylamine, octyl/decyloxyethylamine, otyl/decyloxypropylamine, iso decyloxyethylamine, isodecyloxypropylamine, isododecyloxyethylamine, isododecyloxypropylamine, isotridecyloxyethylamine, isotridecyloxypolyproxypropylamine, isotridecyloxypoly-$C_2$-$C_4$-oxypropylamine, isotridecyloxypropylamine, $C_{12}$-$C_{15}$-alkyloxyethylamine, $C_{12}$-$C_{15}$-alkyloxypropylamine, $C_{16}$-$C_{18}$-alkyloxyethylamine, $C_{16}$-$C_{18}$-alkyloxypropylamine, isodecyloxyethyl-1,3-diaminopropane, isodecyloxypropyl-1,3-diaminopropane, iso dodecyloxyethyl-1,3-diaminopropane, iso dodecyloxypropyl-1,3-diaminopropane, isotridecyloxyethyl-1,3-diaminopropane, isotridecyloxypropyl-1,3-diaminopropane, and the like.

Epoxide Compound

A suitable epoxide compound may be selected from the group consisting of:

1,3-Butadiene diepoxide
Cyclohexene oxide
Cyclopentene oxide
Dicyclopentadiene dioxide
1,2,5,6-Diepoxycyclooctane
1,2,7,8-Diepoxyoctane
1,2-Epoxybutane
cis-2,3-Epoxybutane
3,4-Epoxy-1-butene
3,4-Epoxycyclohexylmethyl 3,4-epoxycyclohexanecarboxylate
1,2-Epoxydodecane
1,2-Epoxyhexadecane 1,2-Epoxyhexane
1,2-Epoxy-5-hexene
1,2-Epoxy-2-methylpropane
exo-2,3-Epoxynorbornane
1,2-Epoxyoctane
1,2-Epoxypentane
1,2-Epoxy-3-phenoxypropane
(2,3-Epoxypropyl)benzene
N-(2,3-Epoxypropyl)phthalimide
1,2-Epoxytetradecane
exo-3,6-Epoxy-1,2,3,6-tetrahydrophthalic anhydride
3,4-Epoxytetrahydrothiophene-1,1-dioxide
Isophorone oxide
Methyl-1,2-cyclopentene oxide
2-Methyl-2-vinyloxirane
α-Pinene oxide
Ethylene oxide
(±)-propylene oxide
Polyisobutene oxide
cis-Stilbene oxide
Styrene oxide
Glycidol
Glycidol ethers
Tetracyanoethylene oxide
Tris(2,3-epoxypropyl) isocyanurate and combinations of two or more of the foregoing. A particularly suitable epoxide may be selected from ethylene oxide, propylene oxide, and glycidol.

The polyhydroxy ether amines may be made in one stage or two stages. The reaction may be carried out by contacting and mixing an alcohol or ether alcohol with an epoxide to form an alkoxylated alcohol, aminating the alkoxylated alcohol with ammonia in the presence of a catalyst to form an alkoxylated alkylamine, and subsequently reacting the alkoxylated alkylamine with an epoxide to form the alkoxylated ether amines. The mole ratio of alcohol to epoxide may range from about 1 to about 8, such as a mole ratio of alcohol to epoxide ranging from about 2 to about 4. The mole ratio of ammonia or amine to alkoxylated alcohol may range from about 1 to about 10. The mole ratio of epoxide to alkoxylated alkylamine may range from about 1 to about 5. In one embodiment, only one epoxy group is added to each NH group. The reactions may be conducted at temperatures ranging from about 0° C. to about 160° C. In another embodiment, the ether amine could be made by reacting a hydrocarbyl ether with acrylonitrile followed by reduction of the resulting intermediate.

One or more additional optional compounds may be present in the fuel compositions of the disclosed embodiments. For example, the fuels may contain conventional quantities of octane improvers, corrosion inhibitors, cold flow improvers (CFPP additive), pour point depressants, solvents, demulsifiers, lubricity additives, additional friction modifiers, amine stabilizers, combustion improvers, dispersants, detergents, antioxidants, heat stabilizers, conductivity improvers, metal deactivators, carrier fluid, marker dyes, organic nitrate ignition accelerators, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, 2-ethylhexanol, and the like.

In one embodiment, a fuel additive package may contain the above described polyhydroxyalkyl ether amine additive in combination with a carrier fluid and other ingredients selected from fatty amine ethoxylates; one or more detergents selected from Mannich bases, polyalkylamines, polyalkylpolyamines, polyalkenyl succinimides, and quaternary ammonium salt detergents. Quaternary ammonium salt detergents may be selected from compounds of the formula

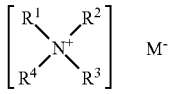

wherein each of $R^1$, $R^2$, $R^3$, and $R^4$ is selected from a hydrocarbyl group containing from 1 to 50 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 50 carbon atoms, $M^-$ is selected from the group consisting of carboxylates, nitrates, nitrides, nitrites, hyponitrites, phenates, carbamates, carbonates, and mixtures thereof, wherein the carboxylate is not an oxalate or formate; alkoxylated quaternary ammonium salts derived from epoxides, tertiary amines, and optional protonating agents; reaction products of amido amines or acylated amines containing at least one tertiary amino group and epoxides; reaction products of hydrocarbyl substituted anhydrides, tertiary amines and hydroxyl-containing epoxides; esterified quaternary ammonium salts derived from tertiary amines, epoxides, proton donors and anhydrides; reaction products of hydrocarbyl substituted compounds containing at least one tertiary amino group selected from $C_{10}$-$C_{30}$-alkyl or alkenyl-substituted amidopropyldimethylamines and $C_{12}$-$C_{200}$-alkyl or alkenyl-substituted succinic-carbonyldimethylamines and halogen substituted $C_2$-$C_8$ carboxylic acids, esters, amides, or salts thereof; and mixtures two or more of the foregoing detergents.

Suitable carrier fluids may be selected from any suitable carrier fluid that is compatible with the gasoline and is capable of dissolving or dispersing the components of the additive package. Typically the carrier fluid is a hydrocarbyl polyether or a hydrocarbon fluid, for example a petroleum or synthetic lubricating oil basestock including mineral oil, synthetic oils such as polyesters or polyethers or other polyols, or hydrocracked or hydroisomerised basestock. Alternatively the carrier fluid may be a distillate boiling in the gasoline range. The amount of carrier fluid contained in the additive package may range from 10 to 80 wt %, preferably from 20 to 75 wt %, and more preferably from 30 to 60 wt % based on a total weight of the additive package. Such additive packages containing the polyhydroxyalkyl ether amine additive, detergent and carrier fluid was found to remain as clear fluids even at temperatures as low as −20 to −30° C.

The additives of the present application, including the polyhydroxylalkyl ether amines described above, and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of gasoline engines. The engine include both stationary engines (e.g., engines used in electrical power generation installations, in pumping stations, etc.) and ambulatory engines (e.g., engines used as prime movers in automobiles, trucks, road-grading equipment, military vehicles, etc.).

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

In the following example, a friction test was conducted on a GF-5 lubricating oil that was devoid of friction modifiers using a high frequency reciprocating rig (HFRR) under a 4N load with a stroke distance of 1 millimeter at 20 Hz at 70° C., 100° C. and 130° C. according to ASTM D6079. The base lubricating oil contained a GF-5 dispersant/inhibitor (DI) package that contained no friction modifiers.

Inventive additives were made as follows:

Inventive Additive 1

An alkyl amine ethoxylate, $C_{13}O(PO)_3N(EO)_2$, made by reaction of $C_{13}OH$ with propylene oxide was followed by reductive amination and was then reacted with 2 equivalents of ethylene oxide to yield Inventive Additive 1.

Inventive Additive 2

Inventive Additive 2 was made using the process of Inventive Example 1 except that $C_{13}OH$ is replaced by a mixture of $C_{16}$ and $C_{18}$ alcohols.

Inventive Example 3

Inventive Example 3 was bis(2-hydroxyethyl) isotridecyloxylpropylamine.

Inventive Example 4

Inventive Example 4 was a reaction product of dodecyl/tetradcyloxypropyl-1,3-diamineopropane with three equivalents of ethylene oxide.

The treat rate of the additive and the results are given in the following table.

TABLE 1

Oil HFRR data

| No. | Additive | Treat rate (wt. %) | Coefficients of friction at 130° C. |
|---|---|---|---|
| 1 | Base lubricant plus DI package | 0 | 0.159 |
| 2 | No. 1 plus additive of Inventive Ex. 1 | 0.125 | 0.123 |
| 3 | No. 1 plus additive of Inventive Ex. 2 | 0.125 | 0.116 |
| 4 | No. 1 plus additive of Inventive Ex. 3 | 0.125 | 0.139 |

Some of the additive in the fuel is transferred into the lubricant within the piston area between the liner and the ring and accumulates in the lubricant in the oil sump over time. Thus, the performance of the inventive examples in reducing the coefficient of friction as shown in Table 1 is indicative of the beneficial effect of the present invention on friction and wear in the piston ring zone as well as reducing friction in the other engine components. As shown by the foregoing examples, the inventive examples (Runs 2-4) exhibited reduced friction in a lubricant composition compared the base lubricant devoid of friction modifiers (Run 1).

Modified Sequence VI E Dynamometer Testing

The following results were from top-treat additions of friction modifiers to a Sequence VIE motor oil (Table 2) and fuel (Table 3) while the engine was operating at high temperature and load. The modified Sequence VIE testing was carried out using a General Motors 3.6 L (LY7) V6, 4-cycle engine equipped with dual overhead camshafts and having four valves per cylinder and also equipped with a dual stage Plenum induction manifold with 94×85.6 mm bore & stroke with 10.2:1 compression ratio. The test fuel was the Sequence VI E reference fuel and the motor oil was a formulated SAE 0W-20 passenger car engine oil containing all of the standard engine oil components, but containing no friction modifiers. To make the top-treated lubricant, the friction modifier to be tested was solubilized in the Sequence VIE motor oil. The concentration of FM in the top-treat was sufficient to provide the concentration of 0.125 wt. % of friction modifier in the crankcase lubricant. The engine was operated with the baseline engine oil at 1500 rpm, a torque of 150 N-m, an oil temperature of 115° C. and a coolant temperature of 109° C. until the temperatures stabilized. The brake specific fuel consumption (BSFC) was measured for approximately one hour after stabilization. The top-treated lubricant containing the friction modifier was then added to the crankcase. Upon the addition of the top-treated lubricant, the BSFC decreased over the course of about five minutes. After the BSFC stabilized, the fuel consumption was measured for approximately one hour. The fuel economy improvement was calculated from the average BSFC before and after the addition of the friction modifier top-treat.

TABLE 2

Fuel Economy Increase

| Run No. | Friction Modifier in engine oil | % Fuel Economy Increase |
|---|---|---|
| 1 | Base oil, plus no top treat additive | 0 |
| 2 | Base oil, plus glycerol monooleate | 0.42 |
| 3 | Base oil, plus - diethanolamine fatty amide derived from fatty acid and diethanol amine | 0.24 |
| 4 | Base oil plus Inventive Example 1 | 1.19 |
| 5 | Base oil plus Inventive Example 2 | 1.08 |
| 6 | Base oil plus Inventive Example 3 | 0.93 |
| 7 | Base oil plus Inventive Example 4 | 1.02 |

The results in Table 3 were obtained from fuel dosed with friction modifiers. The fuel was dosed with 480 ppm of the friction modifier tested and the fuel economy was determined in the same manner as with the top-treated lubricant runs.

TABLE 3

Fuel Economy Increase

| Run No. | Friction Modifier dosed into the fuel at a concentration of 480 ppm | % Fuel Economy Increase |
|---|---|---|
| 8 | Fuel plus - diethanolamine fatty amide derived from fatty acid and diethanol amine | <0.2 |
| 9 | Fuel plus Inventive Example 1 | 0.4 |

As shown in the foregoing tables, all of the inventive examples provided significant fuel economy increase in an engine oil composition compared to the base oil composition that was devoid of the inventive friction modifiers. The fuel dosed with the friction modifier of Inventive Example 1 provided significantly better fuel economy increase than the fuel of Run 2 containing a diethanolamine fatty amide.

An important characteristic of the fuel additives of the disclosure is the low temperature stability of a fuel additive package containing the above described polyhydroxy ether amine. An advantage of providing the additive in a fuel additive package rather than in a lubricant composition is that the additive is continually renewed over time as fuel is combusted in the engine. By contrast, as the lubricant ages, additives provided by the lubricant are typically depleted over time. Accordingly, in order to provide sufficient additive to a fuel to improve the fuel economy of an engine, the additive package containing the foregoing polyhydroxy ether amine must be stable in the fuel additive package. By "stable" is meant the additive package remains a clear fluid at temperatures as low as −20° C. over a period of time.

In the following example, the storage stability of a conventional gasoline fuel additive package containing Inventive Examples 1-3 (Ex. Nos. 4-6) were compared to additive packages containing conventional friction modifiers. All of the samples in the following table contained 53.85 wt. % of the conventional gasoline fuel additive package and the amount of additive and solvent shown.

TABLE 4

Storage Stability at −20° C.

| Ex. No. | Additive | Treat rate (wt. %) | Solvent Wt.% | 1 day | 1 week |
|---|---|---|---|---|---|
| 1 | Cocoamine diethoxylate in aromatic solvent | 30.77 | 15.38 | frozen | frozen |
| 2 | Tallowamine diethoxylate in aromatic solvent | 30.77 | 15.38 | frozen | frozen |
| 3 | diethanolamine fatty amide derived from fatty acid and diethanol amine | 30.77 | 15.38 | Clear and bright | Clear and bright |
| 4 | Inventive Ex. 1 in aromatic solvent | 30.77 | 15.38 | Clear and bright | Clear and bright |
| 5 | Inventive Ex. 2 in aromatic solvent | 30.77 | 15.38 | Clear and bright | Clear and bright |
| 6 | Inventive Ex. 3 in aromatic solvent | 30.77 | 15.38 | Clear and bright | Clear and bright |
| 7 | Mixture of cocoamine diethoxylate and Inventive Ex. 1 in aromatic solvent (1:2 weight ratio) | 10.26/20.5 | 15.38 | Clear and bright | Clear and bright |
| 8 | Mixture of cocoamine diethoxylate and Inventive Ex. 1 in aromatic solvent (1:1 weight ratio) | 15.38/15.38 | 15.38 | Clear and bright | Clear and bright |

As shown in the foregoing table, all of the Inventive Examples 1-3 remained clear and bright after a week at a temperature of −20° C. (Ex. Nos. 4-6) compared to conventional friction modifiers Ex. Nos. 1-2. Furthermore, Ex. Nos. 7-8, showed that a combination of inventive friction modifier and conventional friction modifier may be used to improve the low temperature storage stability of a conventional friction modifier in a fuel additive composition.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method for improving fuel economy in an engine comprising providing a fuel composition to an engine, wherein the fuel composition comprises gasoline and from about 10 to about 750 ppm by weight based on a total weight of the fuel composition of a fuel stable additive of the formula

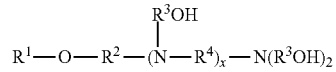

wherein $R^1$ comprises a saturated hydrocarbyl group having from 6 to 30 carbon atoms, $R^2$ is an alkylene, polyalkylene, alkoxyalkylene, or polyalkoxyalkylene group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1, and combusting the fuel composition in the engine.

2. The method of claim 1, wherein the engine comprises a direct fuel injected gasoline engine.

3. The method of claim 1, wherein the fuel composition contains from about 40 to about 250 ppm by weight of the fuel stable additive based on a total weight of the fuel composition.

4. The method of claim 1, wherein $R^1$ comprises a saturated hydrocarbyl group having from 8 to 18 carbon atoms.

5. The method of claim 1, wherein $R^2$ comprises an alkylene or alkoxyalkylene group containing from 2 to 10 carbon atoms.

6. The method of claim 5, wherein x is 0 and $R^2$ comprises —$CH_2CH_2CH_2$—.

7. The method of claim 5, wherein x is 1 and $R^4$ comprises —$CH_2CH_2CH_2$—.

8. The method of claim 1, wherein the fuel composition further comprises a fatty amine diethoxylate, wherein a weight ratio of fuel stable additive to fatty amine diethoxylate ranges from about 1:1 to about 2:1.

9. A method for improving the fuel economy in an engine comprising providing to the engine a fuel composition, wherein the fuel composition comprises gasoline and from about 10 to about 750 ppm by weight based on the total weight of the fuel composition of a fuel stable additive that is a polyhydroxyalkyl ether amine, wherein the polyhydroxyalkyl ether amine contains one or more tertiary nitrogen atoms and is devoid of primary and secondary nitrogen atoms, and combusting the fuel composition in the engine.

10. The method of claim 9, wherein the polyhydroxyalkyl ether amine comprises a compound of the formula

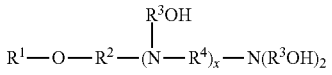

wherein $R^1$ comprises a saturated hydrocarbyl group having from 6 to 30 carbon atoms, $R^2$ is an alkylene, polyalkylene, alkoxyalkylene, or polyalkoxyalkylene group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1.

11. The method of claim 10, wherein $R^1$ comprises a saturated hydrocarbyl group having from 8 to 18 carbon atoms.

12. The method of claim 10, wherein $R^2$ comprises an alkyl or alkoxyalkyl group containing from 2 to 10 carbon atoms.

13. The method of claim 10, wherein x is 0 and $R^2$ comprises —$CH_2CH_2CH_2$—.

14. The method of claim 10, wherein x is 1 and $R^4$ comprises —$CH_2CH_2CH_2$—.

15. The method of claim 9, wherein the engine comprises a fuel injected gasoline engine.

16. The method of claim 9, wherein the fuel composition contains from about 40 to about 250 ppm by weight of the fuel stable additive based on a total weight of the fuel composition.

17. A fuel composition comprising gasoline and from about 10 to about 750 ppm by weight based on the total weight of the fuel composition of an additive of the formula

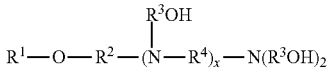

wherein $R^1$ comprises a saturated hydrocarbyl group having from 6 to 30 carbon atoms, $R^2$ is a linear alkylene group containing from 2 to 25 carbon atoms, $R^3$ is an alkyl group containing from 2 to 5 carbon atoms, $R^4$ is a linear alkyl group containing 2 to 3 carbon atoms, and x is an integer selected from 0 and 1.

18. The fuel composition of claim 17, wherein the fuel composition contains from about 40 to about 250 ppm by weight of the additive based on a total weight of the fuel composition.

19. The fuel composition of claim 17, wherein $R^1$ comprises a saturated hydrocarbyl group having from 8 to 18 carbon atoms.

20. The fuel composition of claim 17, wherein $R^2$ comprises —$CH_2CH_2CH_2$—.

21. The fuel composition of claim 17, wherein x is 1 and $R^2$ and $R^4$ comprise —$CH_2CH_2CH_2$—.

22. The fuel composition of claim 17, wherein the fuel composition further comprises a fatty amine diethoxylate, wherein a ratio of additive to fatty amine diethoxylate ranges from about 1:1 to about 20:1.

23. The fuel composition of claim 17, wherein an additive package for the fuel composition comprises the additive, a detergent, and a carrier fluid and the additive package remains a clear fluid at a temperature of −20° C. or below.

* * * * *